US008668085B1

(12) United States Patent
Oliver

(10) Patent No.: US 8,668,085 B1
(45) Date of Patent: Mar. 11, 2014

(54) PAINT BRUSH COVER

(76) Inventor: Andrew D. Oliver, Williamsburg, MI (US)

( * ) Notice: Subject to any disclaimer, the term of this patent is extended or adjusted under 35 U.S.C. 154(b) by 82 days.

(21) Appl. No.: 13/468,156

(22) Filed: May 10, 2012

Related U.S. Application Data

(60) Provisional application No. 61/533,312, filed on Sep. 12, 2011.

(51) Int. Cl.
*B65D 83/10* (2006.01)

(52) U.S. Cl.
USPC ..... 206/361; 15/247

(58) Field of Classification Search
USPC ..... 206/15.2, 15.3, 362.4, 362.1, 362.2, 206/349, 205, 207, 361, 209, 209.1; 383/41, 46, 59, 61.2, 61.3, 63, 68, 69, 383/117, 118; 15/244.3, 247, 184, 248.1, 15/175
See application file for complete search history.

(56) References Cited

U.S. PATENT DOCUMENTS

| | | | | | |
|---|---|---|---|---|---|
| 1,852,679 | A * | 4/1932 | Schneider | 206/362.4 |
| 1,904,609 | A * | 4/1933 | Bleadon | 206/209.1 |
| 2,172,600 | A * | 9/1939 | Van Der Werth | 15/247 |
| 2,353,517 | A * | 7/1944 | Spanel et al. | 206/362.3 |
| 2,485,068 | A * | 10/1949 | Santana | 206/361 |
| 5,139,142 | A * | 8/1992 | Simon | 206/362.3 |
| 5,771,521 | A * | 6/1998 | McNamee | 15/184 |
| 5,791,608 | A * | 8/1998 | Nielsen et al. | 248/110 |
| 5,887,310 | A * | 3/1999 | Wright | 15/209.1 |
| D436,450 | S | 1/2001 | Wilson | |
| 6,199,694 | B1 | 3/2001 | Van Diest et al. | |
| 6,389,637 | B1 * | 5/2002 | Hurell | 15/247 |
| 6,675,966 | B1 | 1/2004 | Ray | |
| 7,111,354 | B2 * | 9/2006 | Nennig et al. | 15/248.1 |
| 7,207,437 | B1 * | 4/2007 | Johansson | 206/15.3 |
| 2001/0047948 | A1 | 12/2001 | Cummings et al. | |
| 2011/0108444 | A1 * | 5/2011 | Shaughness | 206/361 |

OTHER PUBLICATIONS

Paint Brush Protector, Paint Brush Protector—World's First and Only Wet or Dry . . . , www.paintbrushprotector.com webpage, 2011, 1 page, www.paintbrushprotector.com, U.S.

Whitney Innovations, Magna Catch Brush Cover, www.whitneyinnovations.com webpage, Jan. 31, 2010, 1 page, Whitney Innovations (www.archive.org—The Wayback Machine), U.S.

* cited by examiner

*Primary Examiner* — Jacob K. Ackun, Jr.
*Assistant Examiner* — Jenine Pagan
(74) *Attorney, Agent, or Firm* — Northern Michigan Patent Law, PLC

(57) ABSTRACT

A paint brush cover has a bottom opening; a stretchable, breathable, moisture-wicking fabric body with an internal volume less than a volume of an inserted paint brush head; and a top opening narrower than the fabric body and the paint brush head and sized to freely admit the brush handle. A paint brush is inserted handle-first through the bottom opening until the wider brush head registers in a fully covered position with the brush head stretching the fabric body into moisture-wicking contact against the bristles, and with the bristle ends spaced above the bottom opening. The bottom opening may be stiffened with a flexible stiffener that flexes open when a brush head is inserted, or with a closure flap.

11 Claims, 7 Drawing Sheets

PAINT BRUSH COVER

RELATED APPLICATIONS/PRIORITY BENEFIT CLAIM

This application claims the benefit of U.S. Provisional Application No. 61/533,312, filed Sep. 12, 2011 by the same inventor (Oliver), the entirety of which provisional application is incorporated herein by reference.

FIELD

The subject matter of the present application is in the field of covers for handheld paint brushes.

BACKGROUND

Most handheld paint brushes are sold with cardboard brush covers intended to maintain the shape of the brush head between uses, and in particular while the brush is drying after being cleaned. The cardboard, however, prevents the brush head from drying completely, and falls apart after a few uses. Plastic covers are also known, and while more durable, result in even slower drying times.

It is important to dry brush heads completely, since it is difficult to paint well with a wet brush head. Quality brush heads are also expensive, and so a painter may only have a limited number of brushes available to paint with, to wash, and to dry out again for use the next day. These factors make drying time even more important.

It is also preferred to store brush heads bristles-down when they are drying. However, standing them on their bristle ends can deform their shape, and it is often impractical to find convenient places to hang them for drying.

U.S. Pat. No. 6,199,694 to Van Diest et al. discloses a brush head cover with front and rear sheath halves with a bristle-holding portion having an expansible bottom opening for receiving a paint brush in a handle-first orientation, and a ferrule-holding portion with an expansible top opening for allowing the handle to extend from the covered bristles. Between the ferrule-holding portion and the bottom opening, the sheath halves are un-joined and are resiliently separable from each other to allow the bottom opening to expand to receive the paint brush. The brush is pulled out of the sheath through the top opening by grasping and pulling the brush handle. The part of the sheath where the halves are joined forms the ferrule-holding portion, and the part of the sheath where the halves are separable forms the bristle-holding portion. The ferrule-holding portion includes interior ridges to engage the parallel raised ridges formed on the typical paint brush ferrule, in order to secure the paint brush in the sheath. The top opening has flaps that act as retaining members that tend to keep the brush in place regardless of the orientation of the sheath.

The molding and tolerances required for the Van Diest '694 plastic cover would appear to make manufacturing relatively difficult and expensive. The living hinge and the alignment of the separable halves appear to be prone to fatigue and misalignment over time. Insertion of the brush handle-first through the bottom opening and past the relatively stiff bottom edges is believed to be more difficult than implied. The bottom opening also appears to remain open after the brush is inserted, which unless the rigid cover is properly matched to the brush, exposes the bristle ends to deformation. Finally, despite the lower open end and a plurality of ventilation holes formed in the faces of the plastic sheath halves, drying time is believed to be relatively slow.

U.S. Pat. No. 6,675,966 to Ray discloses a paintbrush cover or "shuck" made from panels: a back panel, a bottom panel, a front panel, a pair of side panels, and a pair of front flaps, defining a chamber having an open top with a fastener. The major panels have screen mesh to facilitate the drying of the brush. A top flap with a snap fastener selectively closes the open top of the chamber and a front portion. The panels are joined by fold lines, and it appears that the cover is folded around the brush head after the brush handle is inserted through an opening ("throughbore") in the top flap, a procedure that appears to be somewhat cumbersome for the painter, especially with a wet brush.

None of the foregoing brush covers is sufficiently practical, neat, cost-effective, easy to use, protective, and quick-drying to be useful for serious painters who use a significant number of good brushes.

BRIEF SUMMARY

I have invented a brush cover that allows the brush head to dry completely in less than a day; that protects the shape of the brush head, even when stored bristles-down on a hard surface; and that can be applied and removed quickly and neatly without deforming the brush head.

My brush cover is made from a breathable, stretchable fabric material that is either moisture-wicking by nature, or lined with a moisture-wicking material. The cover in one embodiment has a stiffened bottom opening of substantially fixed width, as wide or wider than the widest part of the brush head(s) it is intended to cover. The cover further has a stretchable fabric body sized to be stretched by the brush head when the brush head is inserted past the bottom opening, so that the moisture-wicking material is in substantially conforming contact with the wet bristles of the brush head.

In one form the bottom opening is biased to an at least partially closed or narrowed state to retain and protect the bristles, but can be flexed open by finger pressure or by the insertion of the brush head to retain and protect the bristles. The bottom opening is sufficiently stiff that it protects the bristle ends from deforming when the brush is stood on end to dry. In an alternate form, the bottom opening is provided with a cover flap of breathable material. In a further form, the bottom opening is stiffened by the flap.

In a further form, the top opening is narrower than the widest part of the brush head. In a preferred form, the top opening comprises a neck substantially narrower than the main fabric body, and accordingly substantially narrower than the brush head, but is sized to admit the handle freely. The narrowed top opening preferably defines shoulders sized to register the brush head in the cover once the bristles are inserted past the bottom opening. In a further form, the top opening is cut with a concave arc that improves brush head release.

These and other features and advantages of the invention will become apparent from the detailed description below, in light of the accompanying drawings.

DETAILED DESCRIPTION

Figure 1:
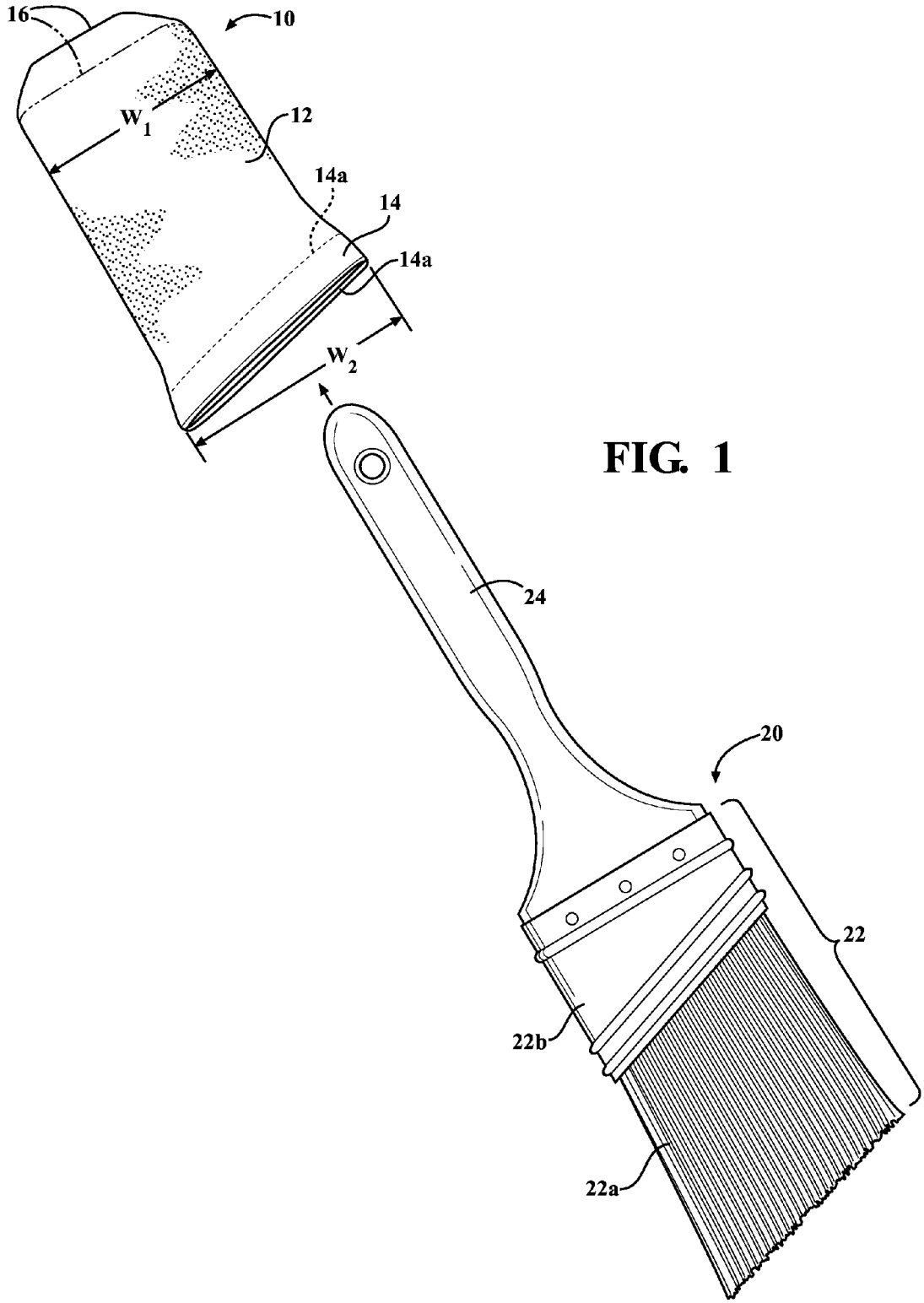
FIG. 1 is a perspective view of a paint brush positioned to be inserted handle-first into a cover according to the invention.

Referring first to FIG. 1, a paint brush cover 10 is shown in exemplary form in order to teach how to make and use the claimed invention. Cover 10 has a body 12 made from a stretchable, breathable fabric such as neoprene or a nylon/spandex blend, a stiffened bottom opening 14, and a stretchable top opening 16. Cover 10 is adapted to receive and cover the brush head 22 of a paint brush 20.

The fabric of body 12 is moisture-wicking, drawing moisture from the paint brush head 22 to its outer surface. The moisture-wicking property may be an inherent quality of the main body fabric, or it may be provided by a moisture-wicking lining material or treatment on the inner surface that works in complementary fashion with the breathable body fabric. Fabric body 12 is also stretchable, in the embodiment of FIG. 1 with a width W1 less than the width W2 of bottom opening 14.

In the example of FIG. 1, bottom opening 14 is stiffened in a manner that gives it a spring- or flex-bias to a partially closed condition. In the illustrated embodiment, bottom opening 14 is stiffened with one or more spring steel or plastic inserts shown in hidden lines at 14*a*, for example one insert 14*a* on each side (front and back) of the cover. Inserts 14*a* can be hidden underneath or inside fabric around the opening, as shown, or the inserts could comprise the bottom opening without any fabric covering. Stiffened bottom opening 14 has an essentially fixed width W2 wider than the widest part of brush head 22, including during any flexing or displacement of the inserts that occurs when the brush head 22 is inserted through bottom opening 14.

Figure 2:
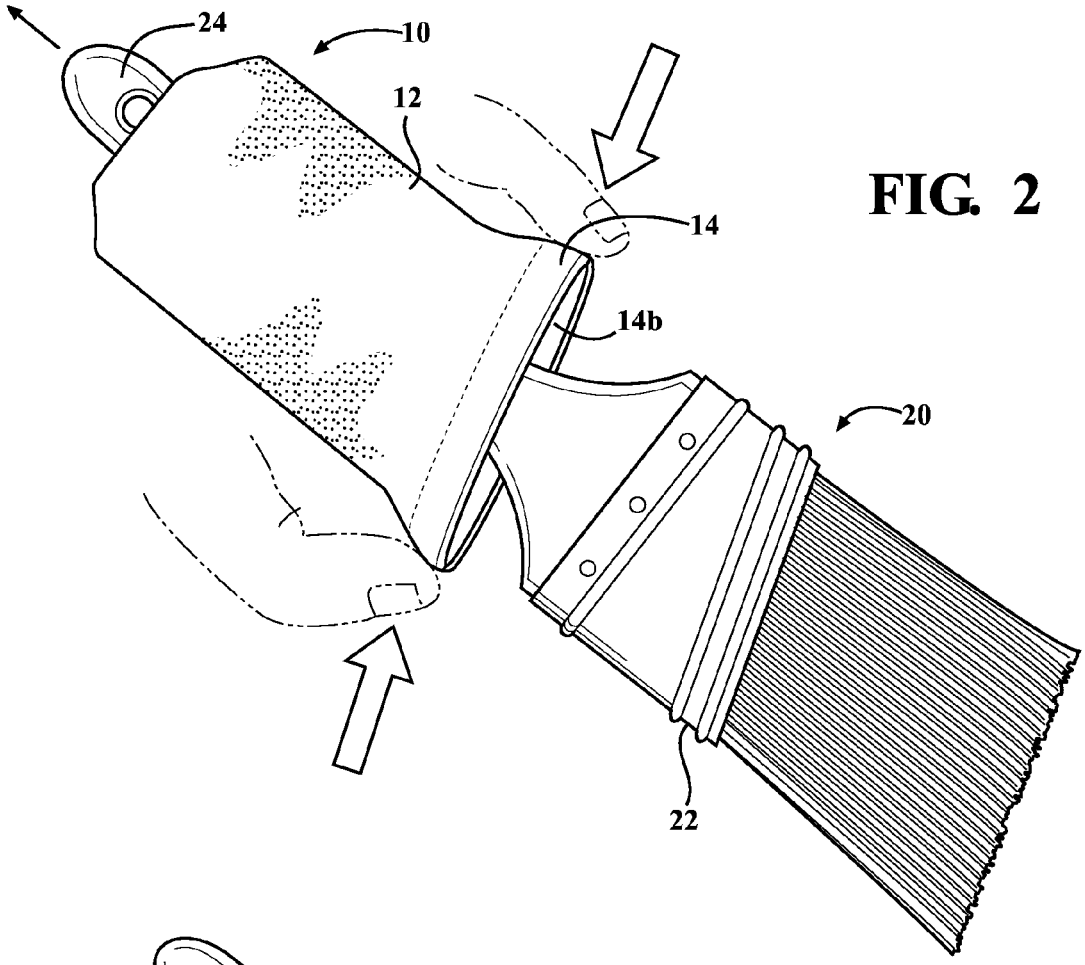
FIG. 2 shows the paint brush inserted partway into the cover of FIG. 1.

Referring to FIG. 2, stiffened bottom opening can be forced or flexed apart by the entry of a paint brush head, or by gently squeezing the outer ends of the bottom opening toward the center of the opening as illustrated with the arrows in FIG. 2 to widen the actual opening 14*b*. The flex or spring bias of the bottom opening 14 returns the opening to its "closed" condition after the entry or opening force is removed.

It may also be possible to bias the opening 14 so that it stays open after the initial application of opening force, for example flexing the inserts to an over-center position where they stay open, and then requiring a closing force to be applied to return the opening to its closed condition. The opening in that case might be described as "snapping" open and "snapping" closed.

The term "closed" as applied to bottom opening 14 should be understood to mean at least partially closed or narrowed, up to and including fully closed. The extent of closure of the actual opening 14*b* will depend on the tolerances and strength of inserts 14*a*, and on the preference of the manufacturer and/or end user. However, opening 14*b* is preferably narrowed in its "closed" condition to a front-to-back depth less than the thickness of the end of bristle portion 22*a* of brush head 22, to help retain and protect the bristle ends.

Figure 3:
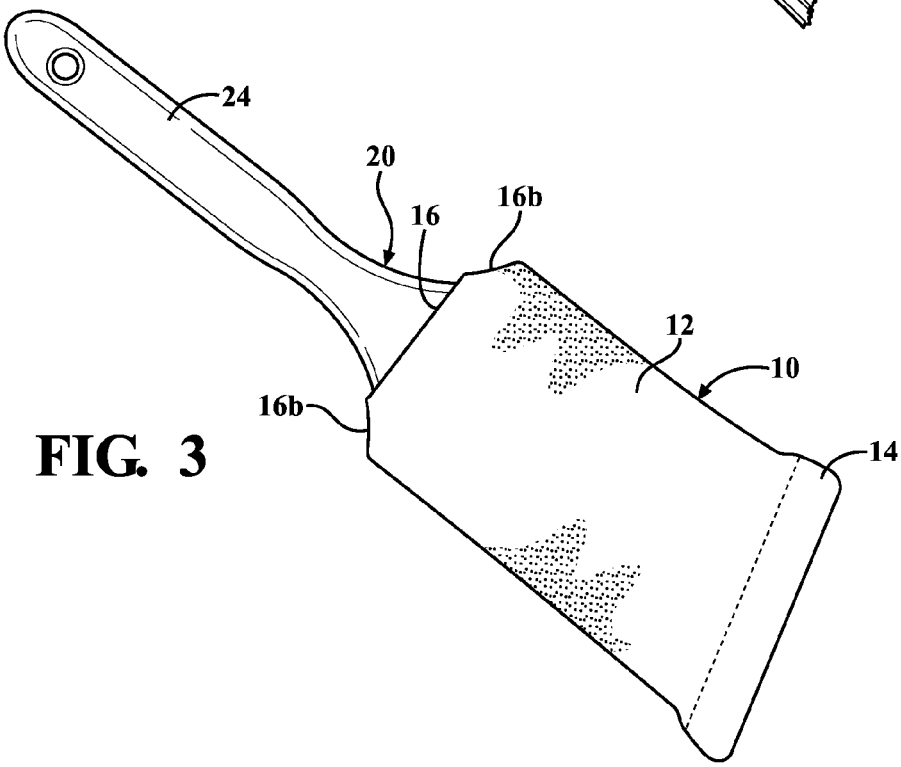
FIG. 3 shows the paint brush inserted fully into the cover of FIG. 1.

FIG. 3 shows brush head 22 fully inserted in the cover 10 of FIG. 1. The width W1 of fabric body 12 is less than width W2 of bottom opening 14 before the brush head is inserted, so that insertion of a brush head 22 sized to fit through non-stretching bottom opening 14 will stretch fabric body 12. The stretching of the fabric body 12 keeps its moisture-wicking fabric in contact with the wet bristles 22*a* of the covered brush head, reducing the time needed for the bristles to dry.

The front-to-back spacing of fabric body 12 is also less than that of bottom opening 14, and thus less than the depth or thickness of brush head 22, in order to increase the contact of the stretchable fabric with the surface of bristles 22*a*. Not only the width, but the interior volume of the fabric body 12 (corresponding to at least a substantial portion of the bristles of the paint brush head 22) has a smaller unstretched volume than the volume of the paint brush head. Insertion of the paint brush head into fabric body 12 accordingly causes the interior of the fabric body to be in substantially conforming contact with the bristles of the paint brush head. This lesser volume and conforming fit of the fabric body 12 relative to the paint brush head 22 may be achieved with a narrower side-to-side width alone, relying on the stretchable nature of the fabric in body 12; or with a reduced front-to-back depth alone and a body width approximately equal to the brush head as shown in the embodiments of FIGS. 7-11; or with both narrower width and reduced depth of the fabric body 12 relative to the paint brush head. The conforming fit also helps keep the brush head positively registered in its fully inserted position in the cover.

Figure 3A:
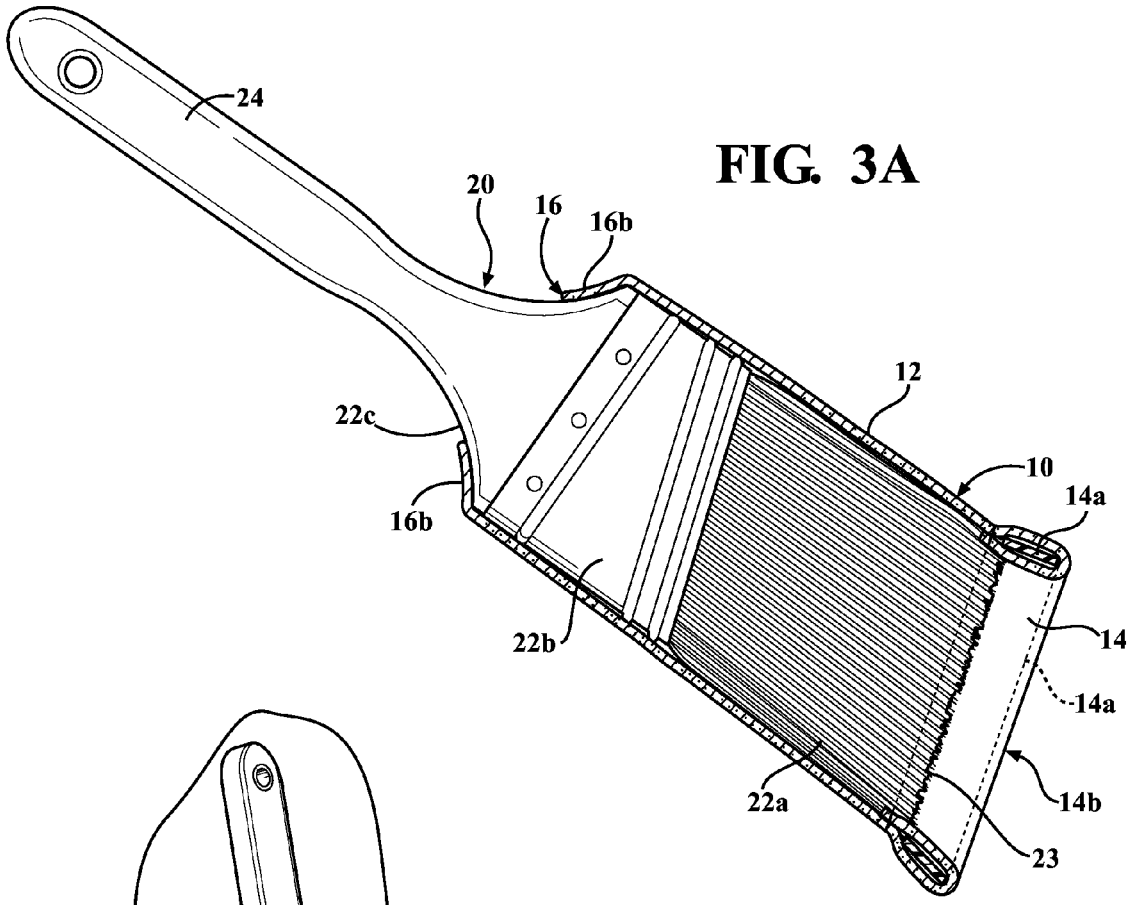
FIG. 3A is similar to FIG. 3, but with a front portion (front face) of the cover cut away to show the position of the brush head relative to the cover in the fully covered, registered position.

FIG. 3A shows brush 20 with its head 22 fully inserted and registered in cover 10. In this position, the upper, rigid part 22*b* of the brush head comprising the ferrule and wooden or plastic shoulder 22*c* has contacted the shoulder 16*b* around constricted top opening 16 on fabric body 12. The ends 23 of bristles 22*b* are located within or above the stiffened bottom opening 14, above the actual opening 14*b* so that they do not protrude from cover 10. Fabric body 12 is stretched by the wider, greater-volume brush head 22 so that its inner surface is in wicking contact with bristles 22*a*.

It will be understood that the stretchable, conforming fabric of body 12 may allow a single cover 10 to accommodate reasonable variations in brush size and shape for paint brushes whose brush heads 22 are able to fit through bottom opening 14. Cover 10 should be matched to a range of brush sizes/shapes to achieve the fit illustrated in FIG. 3A, namely the upper end 22*b* registered against the shoulders 16*b* of the fabric body; the fabric body 12 stretched by the wider/larger brush head 22; and bristle ends 23 spaced above the lower end 14*b* of bottom opening 14. It is preferred, however, to match a cover 10 to a single brush size/shape.

The stretch-conforming fabric body 12 also helps maintain the overall shape of bristle portion 22*a* of brush head 22, as it holds the bristles in compression during the drying process.

Figure 4:
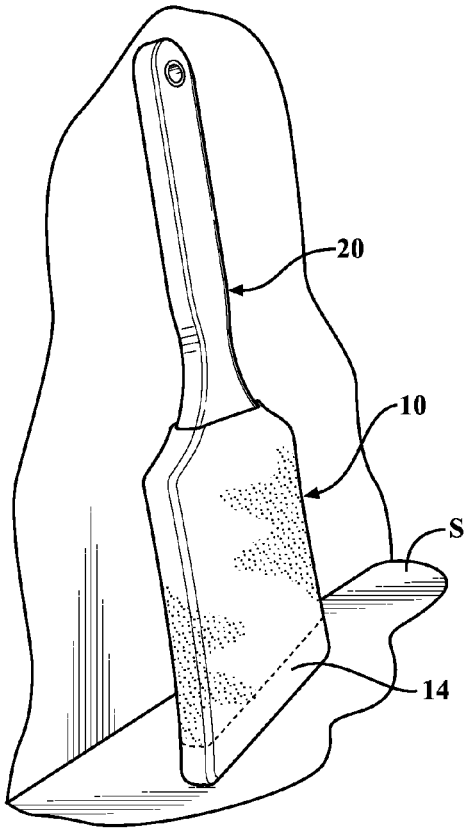
FIG. 4 shows the brush covered with the cover of FIG. 1 standing on end, bristles-down, for drying.

FIG. 4 shows brush 20 with cover 10 resting bristles-down on a surface S for drying. The weight of the brush and cover are on stiffened bottom opening 14, whose stiffness protects the bristles from deforming as the brush dries. The registered position of brush head 22 in cover 10 spaces the ends of the bristles from surface S even if opening 14 remains partially open to aid drying.

Figure 5:
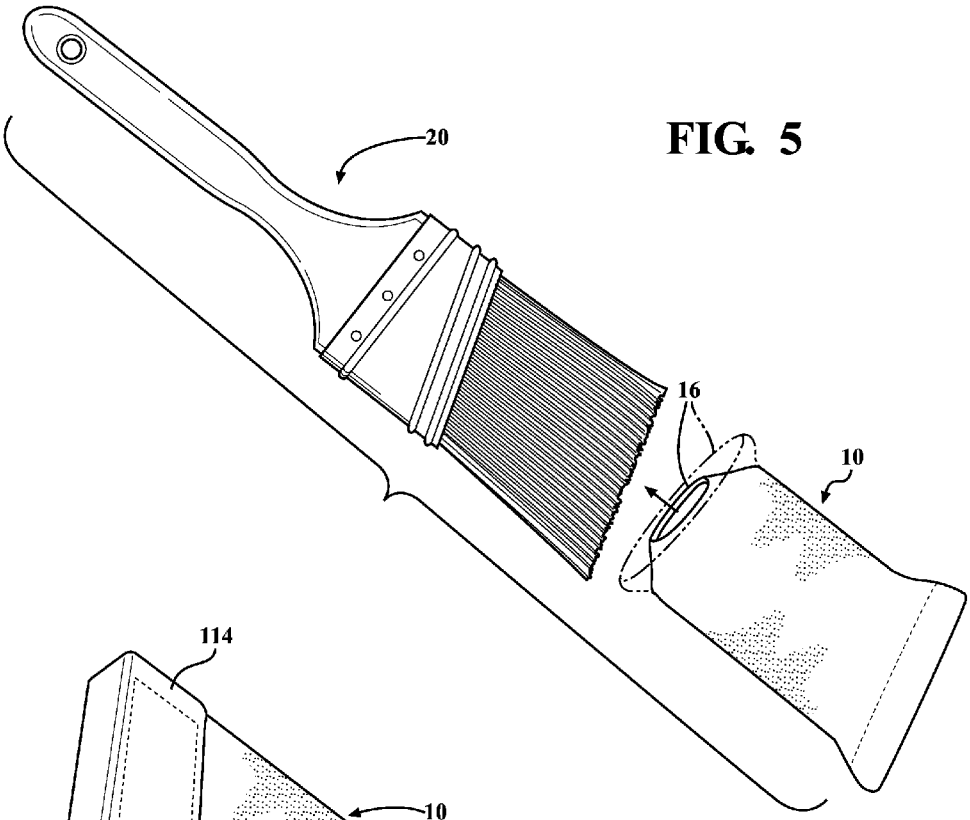
FIG. 5 shows the paint brush after being removed handle first through the top opening of the cover of FIG. 1, and further shows the stretching of the top opening to admit the wider brush head in phantom lines.

FIG. 5 shows brush 20 removed handle-first through top opening 16, which stretches (phantom lines) to admit the wider brush head 22 as the cover is pulled down over the brush and/or the brush is pulled up through the cover.

Figure 6:
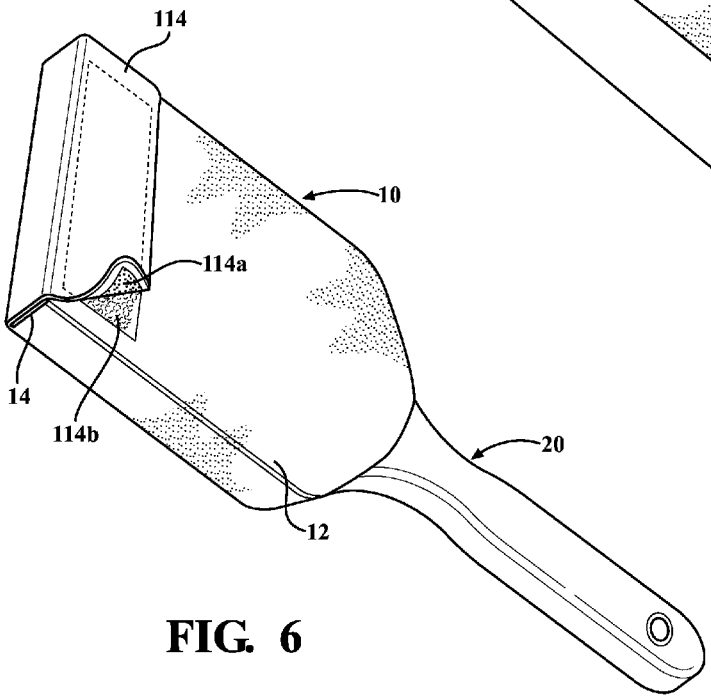
FIG. 6 shows the cover of FIG. 1 modified with a first closure flap over the bottom opening.

FIG. 6 shows a cover 10 modified with a bottom flap 114 over bottom opening 14. Flap 114 may be a flexible, non-stiffened flap over a stiffened bottom opening 14 as described above. Alternately, flap 114 may be a stiffened flap over a non-stiffened bottom opening 14, such that the flap 114 provides the rigidity needed to stand the cover 10 in a bristle-down position without deforming the bristle ends. Flap 114 may be secured in a closed position (illustrated) with mating hook-and-loop portions 114*a* and 114*b*, or with any other known fastening system including but not limited to mechanical and magnetic fasteners.

Flap 114 also makes it possible to use a non-flexing bottom opening 14, since the flap closure eliminates the advantage of a flex closure.

FIGS. 7 through 10 illustrate a second closure flap 214 formed as a single-layer extension of the material of fabric body 12, with fabric piping or similar edge-reinforcement 213. In the illustrated example, piping 213 extends around the edges of fabric body 12 and continues around the perimeter of flap 214. Flap 214 is secured in a closed position of fabric body 12 with suitable fasteners such as mating hook-and-loop material 214*a* and 214*b*. The width of fabric body 12 is also substantially the same as the width of the bottom opening, as shown in the Figures.

Figures 7, 8:
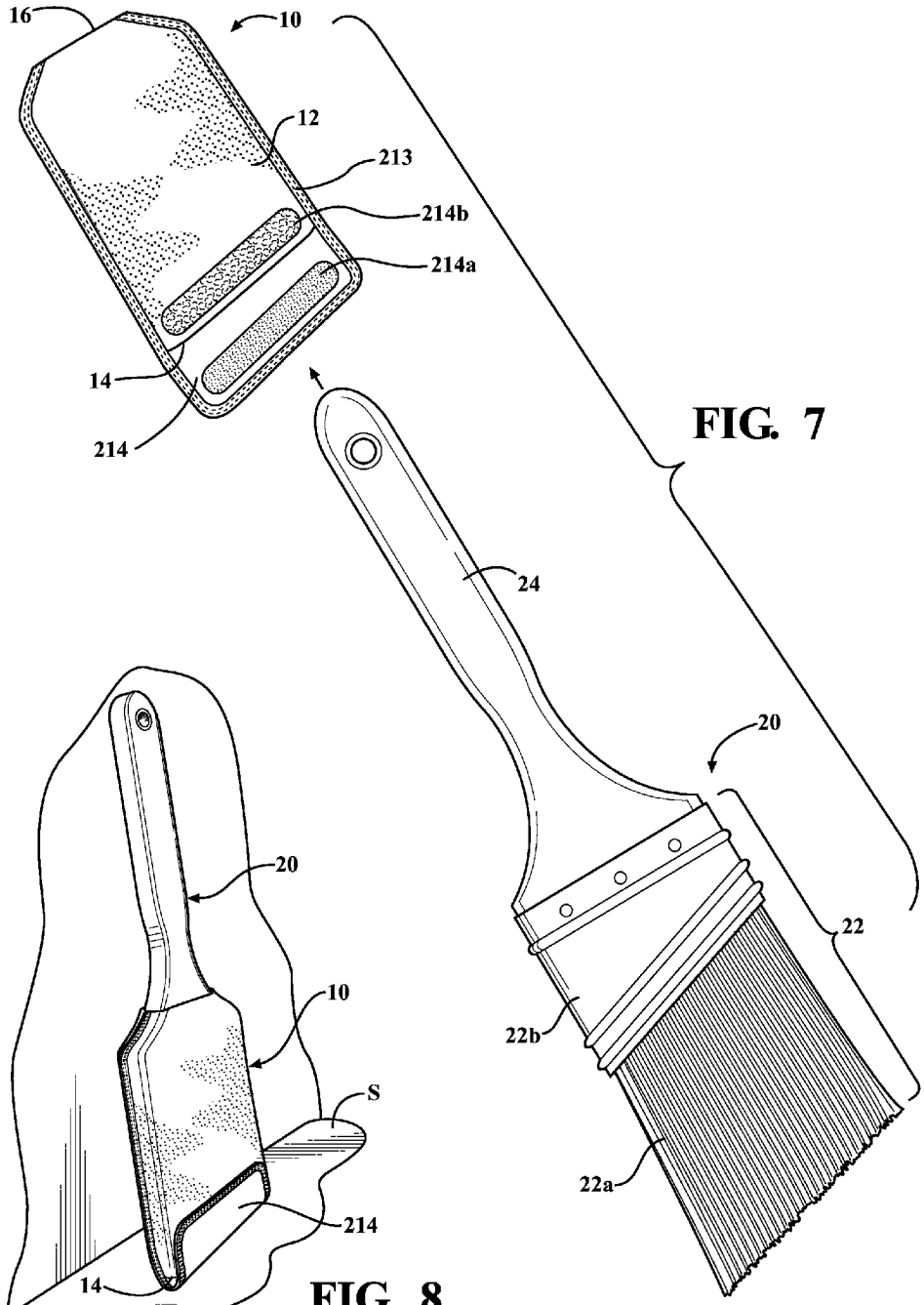
FIG. 7 shows the cover of FIG. 1 modified with a second closure flap over the bottom opening and a body width corresponding to the width of the brush head.
FIG. 8 shows the brush covered with the cover of FIG. 7 standing on end, bristles-down, for drying.
Figure 9:
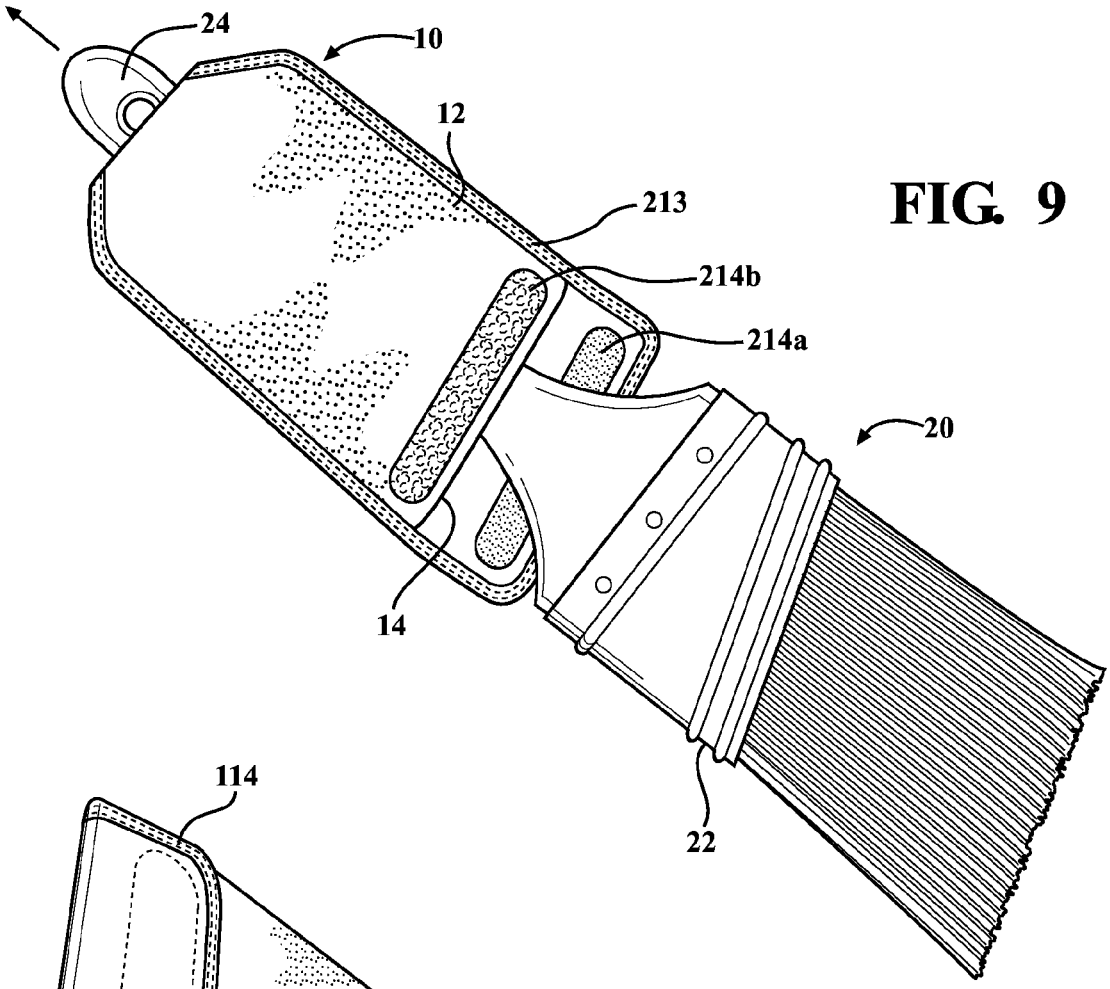
FIG. 9 shows the paint brush inserted partway into the cover of FIG. 7.
Figure 10:
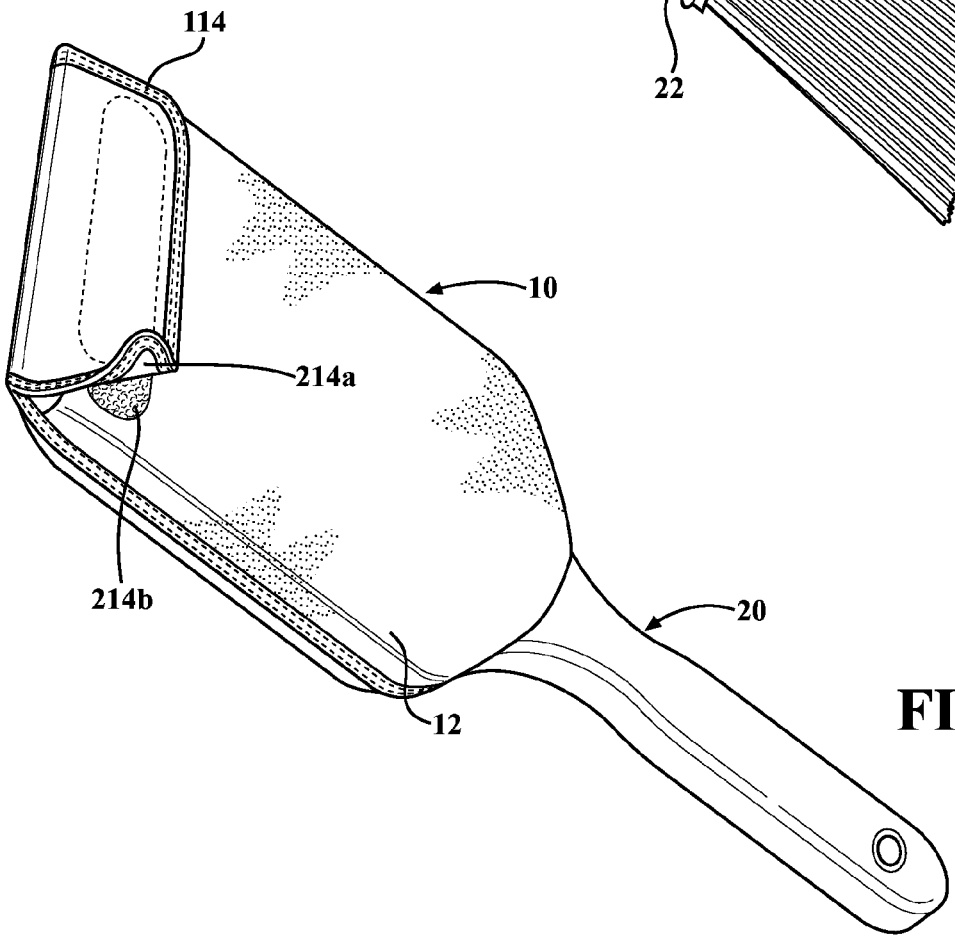
FIG. 10 shows the cover of FIG. 7 with the closure flap closed.

As best shown in FIGS. 8 and 10, flap 214 forms a wedge shape when folded closed, and it has been found that this folded shape provides sufficient stiffening to the fabric of the flap to support the brush in a bristles-down drying position (FIG. 8) without deforming the bristle ends. Piping 213 is believed to add to this stiffening effect. Accordingly, the unstiffened fabric material of flap 214 can be considered "stiffened" when folded, despite the lack of non-fabric stiffening members in the closure flap.

The modified cover 10 in FIGS. 7-10 shows a bottom opening 14 of stretchable fabric having a width substantially equal to the width of the fabric body 12, i.e. approximately equal to the width of the paint brush head.

It has been found that since the closure flap 214 is not stiffened in its open position (FIGS. 7 and 9), the stretchable, conforming nature of the fabric allows the brush head to be inserted without difficulty, and better conforms to the bristle ends 23 when the flap is closed to promote drying and bristle reformation. As in previous embodiments, the internal unstretched volume of the fabric body 12 is less than the volume of the brush head, via reduced width and/or depth relative to the width and depth of the brush head.

Figure 11:
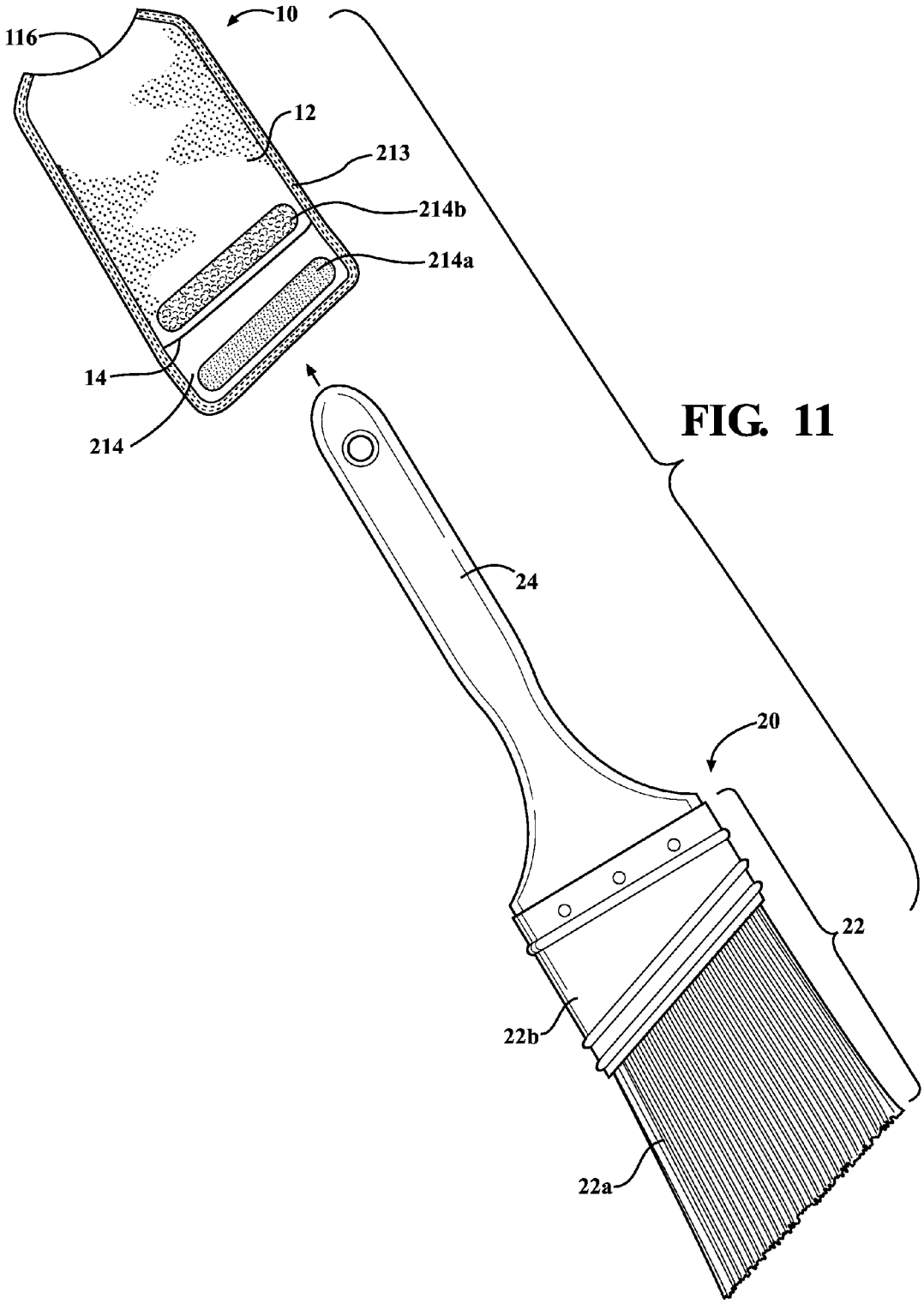
FIG. 11 is similar to FIG. 7, but shows the cover with a modified top opening.

FIG. 11 shows a modified form of the brush cover of FIG. 7, in which top opening 16 has been modified to a concave arc 116 connecting the sides of the cover. Opening 116 has a chordal or straight-line width measured in a straight line from side to side of the cover that is less than the width of brush head 22, and a length that is greater than the width of the brush head. The curvature of opening 116 seems to enhance the effective stretchability of the cover's stretchable fabric, allowing the brush head to be released more smoothly and with less snagging. The curvature of opening 116 accordingly allows the use of fabrics with lower stretchability, if desired.

It will be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention supported by the above disclosure should accordingly be construed within the scope of what it teaches and suggests to those skilled in the art, and within the scope of any claims that the above disclosure supports, whether the claims are made in this application or in a subsequent application claiming priority to this application.

What is claimed is:

1. In combination with a paint brush having a handle and a head with bristles, a paint brush head cover comprising:

a fabric body comprising a stretchable, breathable, moisture-wicking material, the fabric body having an unstretched internal volume less than a volume of the paint brush head and a stretched internal volume sufficient to contain the entirety of the brush head;

a bottom opening in the fabric body, the bottom opening configured to admit both the handle and the brush head of the paint brush in a handle-first orientation, the bottom opening comprising a closure, the closure having an open condition and a closed condition, the closure being stiffened in at least the closed condition and capable of supporting the paint brush head in a bristles down drying position on a surface without deformation of the bristle ends if the paint brush head is inserted in the fabric body and the closure is in the closed condition; and, a stretchable top opening in the fabric body, the top opening having a width less than a width of the fabric body and capable of stretching to admit the brush head of the paint brush therethrough.

2. The paint brush cover of claim 1, wherein the bottom opening has a first width equal to or greater than a width of the paint brush head, and the fabric body has a second unstretched width less than the first width.

3. The paint brush cover of claim 1, wherein the bottom opening and the fabric body have a width equal to or greater than a width of the paint brush head, and further wherein the fabric body has an unstretched front-to-back depth less than a front-to-back depth of the paint brush head.

4. The paint brush cover of claim 1, wherein the closure comprises a non-fabric stiffening member.

5. The paint brush cover of claim 4, wherein the closure comprises a stiffened flap.

6. The paint brush cover of claim 1, wherein the closure comprises an extension of the fabric body that becomes stiff enough to support the paint brush head in a bristles-down position without deformation of the bristles when the fabric extension is folded to a closed condition.

7. The paint brush cover of claim 1, wherein the bottom opening and the fabric body have a width less than a width of the paint brush head.

8. The paint brush cover of claim 1, wherein the top opening comprises shoulders sized to register a ferrule end of the brush head of the paint brush when the paint brush head is inserted in the fabric body of the cover.

9. A paint brush head cover comprising:

a fabric body comprising a stretchable, breathable, moisture-wicking material, the fabric body having an internal volume shaped like and configured to receive a paint brush head and having a first width;

a bottom opening in the fabric body, the bottom opening having a second width equal to or greater than the first width of the fabric body, the bottom opening comprising a closure, the closure having an open condition and a closed condition, the closure being stiffened in at least the closed condition and capable of resting on a surface without deformation when the closure is in the closed condition; and, a stretchable top opening in the fabric body, the top opening having a third width less than the first width of the fabric body but capable of stretching to a width equal to or greater than the first width of the fabric body, wherein the fabric body comprises an upper end including the top opening, the upper end comprising inwardly angled shoulders comprising the same material as the fabric body, the inwardly angled shoulders configured to register the ferrule end of a paint brush head, the shoulders terminating at the top opening.

10. The paint brush head cover of claim 9, wherein the top opening defines a concave arc extending between the inwardly angled shoulders, the concave arc having a chordal width measured in a straight line between the inwardly angled shoulders less than the first width of the fabric body, and the concave arc having an actual length greater than the first width of the fabric body.

11. The paint brush head cover of claim 9, wherein the second width of the bottom opening is substantially fixed.

* * * * *